US009578916B2

(12) United States Patent
Daniels et al.

(10) Patent No.: US 9,578,916 B2
(45) **Date of Patent: *Feb. 28, 2017**

(54) APPLIANCE MOUNTING DEVICE AND SYSTEM FOR HEAD GEAR

(71) Applicant: 3M INNOVATIVE PROPERTIES COMPANY, St. Paul, MN (US)

(72) Inventors: Bjorn Daniels, Vikarbyn (SE); Stefan Aberg, Borlange (SE); Jonas N. A. Frejd, Skedvi (SE); Mats U. Sernfalt, Leksand (SE); Marcus T. R. Wiederkehr, Leksand (SE)

(73) Assignee: 3M Innovative Properties Company, St. Paul, MN (US)

( * ) Notice: Subject to any disclaimer, the term of this patent is extended or adjusted under 35 U.S.C. 154(b) by 81 days.

This patent is subject to a terminal disclaimer.

(21) Appl. No.: 14/177,299

(22) Filed: Feb. 11, 2014

(65) Prior Publication Data

US 2015/0223540 A1 Aug. 13, 2015

(51) Int. Cl.
*A42B 3/22* (2006.01)
*A42B 3/04* (2006.01)

(52) U.S. Cl.
CPC ..... *A42B 3/042* (2013.01); *A42B 3/04* (2013.01); *A42B 3/044* (2013.01)

(58) Field of Classification Search
CPC ..... A42B 1/24; A42B 1/242; A42B 1/244; A42B 1/245; A42B 1/247
USPC ..... 224/181, 272
See application file for complete search history.

(56) References Cited

U.S. PATENT DOCUMENTS

| | | | |
|---|---|---|---|
| D168,057 | S | 10/1952 | Margwarth |
| 2,798,221 | A | 7/1957 | Bailey |
| 2,813,271 | A | 11/1957 | Finken |
| 3,066,305 | A | 12/1962 | Aileo |
| 3,110,034 | A | 11/1963 | Aileo |
| 3,237,202 | A | 3/1966 | Aileo |
| 3,315,272 | A | 4/1967 | Olt |
| 3,373,444 | A | 3/1968 | Militello |
| 3,400,407 | A | 9/1968 | Aileo |
| 3,495,273 | A | 2/1970 | Aileo |
| 3,553,734 | A | 1/1971 | Aileo |
| 3,601,813 | A | 8/1971 | Aileo |

(Continued)

FOREIGN PATENT DOCUMENTS

| | | |
|---|---|---|
| DE | 1735005 | 6/1972 |
| DE | 2913059 | 10/1980 |

(Continued)

OTHER PUBLICATIONS

International Application PCT/US2015/015392 Search Report dated May 15, 2015.

(Continued)

*Primary Examiner* — Adam Waggenspack

(57) ABSTRACT

An appliance mounting device 10 that is adapted for securement to head gear 12. The device 10 has an elongated guide 14 that is adapted for removable attachment to the head gear 12 such that a lengthwise dimension of the elongated guide 14 is at least generally coincident with a sagittal plane 16. An appliance holder 20 supports an appliance 18 and can engage the elongated guide 14 to allow for adjustment of the position of the appliance 18 along the elongated guide 14.

13 Claims, 6 Drawing Sheets

(56) References Cited

U.S. PATENT DOCUMENTS

| | | | | |
|---|---|---|---|---|
| 3,748,657 | A | 7/1973 | Aileo | |
| 3,833,300 | A | 9/1974 | Rymes | |
| 3,945,043 | A | 3/1976 | DeAngelis | |
| 4,280,491 | A | 7/1981 | Berg | |
| 4,287,615 | A | 9/1981 | Morin | |
| 4,434,514 | A | 3/1984 | Sundahl | |
| 4,449,787 | A * | 5/1984 | Burbo et al. | 313/524 |
| 4,457,461 | A * | 7/1984 | Docking et al. | 224/181 |
| 4,670,912 | A | 6/1987 | Hart | |
| 4,901,210 | A * | 2/1990 | Hanabusa | 362/106 |
| 4,907,299 | A | 3/1990 | Arai | |
| 5,177,816 | A | 1/1993 | Schmidt | |
| 5,265,276 | A * | 11/1993 | Kimberly, Jr. | 2/6.2 |
| 5,291,880 | A | 3/1994 | Almovist | |
| 5,467,480 | A | 11/1995 | Baudou | |
| 5,506,730 | A | 4/1996 | Morley | |
| 5,664,868 | A * | 9/1997 | Montalbano et al. | 362/105 |
| 5,914,816 | A | 6/1999 | Soto | |
| 6,472,776 | B1 | 10/2002 | Soto | |
| 6,820,285 | B2 | 11/2004 | Bataille | |
| 7,093,302 | B1 * | 8/2006 | Burns | A61F 9/06 2/8.1 |
| 7,219,370 | B1 * | 5/2007 | Teetzel | A42B 3/04 2/422 |
| 7,549,763 | B2 | 6/2009 | Kim | |
| 7,866,083 | B2 | 1/2011 | Teetzel | |
| 8,209,780 | B1 | 7/2012 | Lemire | |
| 8,312,668 | B2 | 11/2012 | Kincel | |
| 8,322,066 | B2 | 12/2012 | Westra | |
| 8,348,449 | B2 | 1/2013 | McCorkle | |
| 8,375,473 | B2 | 2/2013 | Celona | |
| 8,403,515 | B2 | 3/2013 | Eichelberger | |
| 8,701,212 | B2 | 4/2014 | Daniels | |
| 2002/0148032 | A1 * | 10/2002 | Basson et al. | 2/422 |
| 2003/0115661 | A1 * | 6/2003 | Dobbie et al. | 2/422 |
| 2004/0143888 | A1 | 7/2004 | Bataille | |
| 2009/0038056 | A1 | 2/2009 | Bobbin | |
| 2009/0144872 | A1 | 6/2009 | Lebel | |
| 2009/0307826 | A1 * | 12/2009 | Rogers et al. | 2/422 |
| 2010/0083413 | A1 | 4/2010 | McGovern | |
| 2011/0145981 | A1 | 6/2011 | Teetzel | |
| 2011/0239354 | A1 | 10/2011 | Celona | |
| 2013/0061506 | A1 * | 3/2013 | Atkinson | F41G 11/003 42/90 |
| 2014/0020159 | A1 | 1/2014 | Teetzel | |

FOREIGN PATENT DOCUMENTS

| | | |
|---|---|---|
| EP | 0223139 | 5/1987 |
| EP | 0751720 | 1/1997 |
| FR | 2365934 | 4/1978 |
| FR | 2532528 | 3/1984 |
| FR | 2750299 | 1/1998 |
| GB | 491609 | 9/1938 |
| JP | 06192907 | 7/1994 |
| JP | 2010-138506 | 6/2010 |
| WO | WO 2005-120265 | 12/2005 |
| WO | WO 2006-112735 | 10/2006 |
| WO | WO 2012-007476 | 1/2012 |
| WO | WO 2014/052009 | 4/2014 |

OTHER PUBLICATIONS

Winfield, B., Comfortable Protection, Autoweek, Aug. 2, 2010, 60 (15)26-26.

MSA Cairns® Defender® Visor Compliant as Primary Eye Protection, Fire Engineering, May 2011, p. 135.

Bapu, "High Voltage Quick-Disconnect Harness System for Helmet-Mounted Displays", SAE Technical Paper 929252, Aug. 1992, 5pgs.

* cited by examiner

APPLIANCE MOUNTING DEVICE AND SYSTEM FOR HEAD GEAR

The present invention pertains to an appliance mounting device that can be secured to head gear and that supports an appliance that can be adjusted in position along an elongated guide.

BACKGROUND

Head gear has been developed which supports other items such as appliances. Examples of such products are disclosed in U.S. Pat. Nos. 8,375,473, 8,403,515, 8,348,449, and 8,209,780, U.S Patent Application 2010/0083413 and 2011/0239354, and EP 0751720 B1. These head protection products are commonly used in applications such as industrial production, building construction, and the like. Known head gear, such as hard hats for head protection and welding helmets for eye protection, sometimes needs to have various appliances attached to it to assist the wearer in performing different tasks. Flashlights, for example, are often needed so that wearers can readily see their surroundings and any items that they may be working on. Frequently the flashlight needs to be adjusted in position, or the appliance may need to be removed and replaced with another appliance, or multiple appliances may need to be used concurrently. When no appliances are needed, however, the head gear may be carrying unnecessary weight, which can be cumbersome or uncomfortable to the user, particularly when the wearer has been working for a number of consecutive hours. A versatile appliance mounting device and system is needed which can allow for ease of appliance positioning and which can allow multiple adjustable appliances to be attached to head gear.

SUMMARY OF THE INVENTION

The present invention pertains to an appliance mounting device that is adapted for securement to head gear, which appliance mounting device comprises:

(a) a first elongated guide that is adapted for removable securement to the head gear such that a lengthwise dimension of the elongated guide is at least generally coincident with a sagittal plane of the head gear;

(b) a first appliance; and (c) an appliance holder that supports the first appliance and that can engage the elongated guide to allow for adjustment of the position of the first appliance along the lengthwise dimension of the first elongated guide.

The present invention also provides an appliance system suitable for use with head gear. The appliance system comprises:

(a) a first elongated guide that is arcuate and attachable to head gear at a first location;

(b) a first appliance;

(c) a first appliance holder that supports the first appliance and that can engage the first elongated guide to allow for adjustment of the position of the first appliance along the lengthwise dimension of the first elongated guide;

(d) a second elongated guide that can be attached to the head gear at a second location;

(e) a second appliance; and (f) a second appliance holder that supports the second appliance and that can engage the second elongated guide to allow for adjustment of the position of the second appliance along the lengthwise dimension of the second elongated guide.

Known head gear has been limited in the ability to attach various appliances to it. The mounting hardware has not been able to accommodate various appliances in conjunction with other items like face shields. The known head gear also has been limited in an ability to have the appliances moveable in position on the head gear, both in location and about one or more axes. The present invention is beneficial in that it enables different appliances, in conjunction with other attachable items like face shields, to be secured to the head gear in various locations and in a manner that allows for removability, position adjustment, and appliance rotation.

GLOSSARY

The terms set forth below will have the meanings as defined:

"adjustment of the position" means being able to be moved from a first location to a second location different from the first location;

"appliance" means a device that is operated by electricity;

"appliance holder" means a part(s) that is designed for having an appliance integrally or non-integrally attached to it or supported by it;

"appliance mounting device" means an article that designed to support an appliance during use;

"attached" means secured to directly or indirectly;

"engage" means to be attached to directly and/or indirectly;

"elongated guide" means structure that is substantially longer in one dimension than another and is designed to be capable of receiving another device;

"generally coincident" means substantially in line with;

"harness" means a combination of parts that allows the protective portion of head gear to be supported on a person's head;

"head gear" means a hard hat, helmet, or other device that is worn by a person on their head for protective purposes;

"indirectly" means, with respect to an attachment, that a first part can be joined to a second part through other objects or parts such the first part does not make contact with the second part;

"integral" means joined together such that the parts cannot be separated without damaging at least one of the parts;

"lengthwise dimension" means a line that is generally parallel to and through the longest dimension of the article in question;

"removable attachment" or "removably attached" means designed for being removed manually with causing any damage thereto;

"sagittal plane" means a vertical plane that divides a body into two symmetrical sections; and "secured" or "securement" means attached to directly such that contact is made between the two parts being joined.

DETAILED DESCRIPTION OF PREFERRED EMBODIMENTS

In practicing the present invention, an appliance mounting device and system is provided which enables one or more appliances to be secured to an item of head gear. The appliance mounting device includes an elongated guide that can be removably attached to the head gear such that the lengthwise dimension of the elongated guide is at least generally coincident with the sagittal plane of the head gear. An appliance holder supports an appliance and engages the elongated guide. The appliance holder allows for positioning adjustments of the appliance along the lengthwise dimension of the first elongated guide. The appliance holder also can be designed to allow the appliance to be rotated about one or more axes while in the appliance holder. The appliance holder too may be fashioned to be removed from the elongated guide so that it can be attached at a second location on the head gear where position adjustments also may be made. Multiple appliances also can be attached to multiple elongated guides so that different appliances or more than one appliance of the same kind can be used on the head gear contemporaneously. The invention thus is very versatile in that it allows the appliance(s) to be located at various positions along the elongated guide(s) or at other positions on the head gear while also having the ability to be rotated about an axis so that the best position(s) for the use at hand may be achieved.

Figure 1:
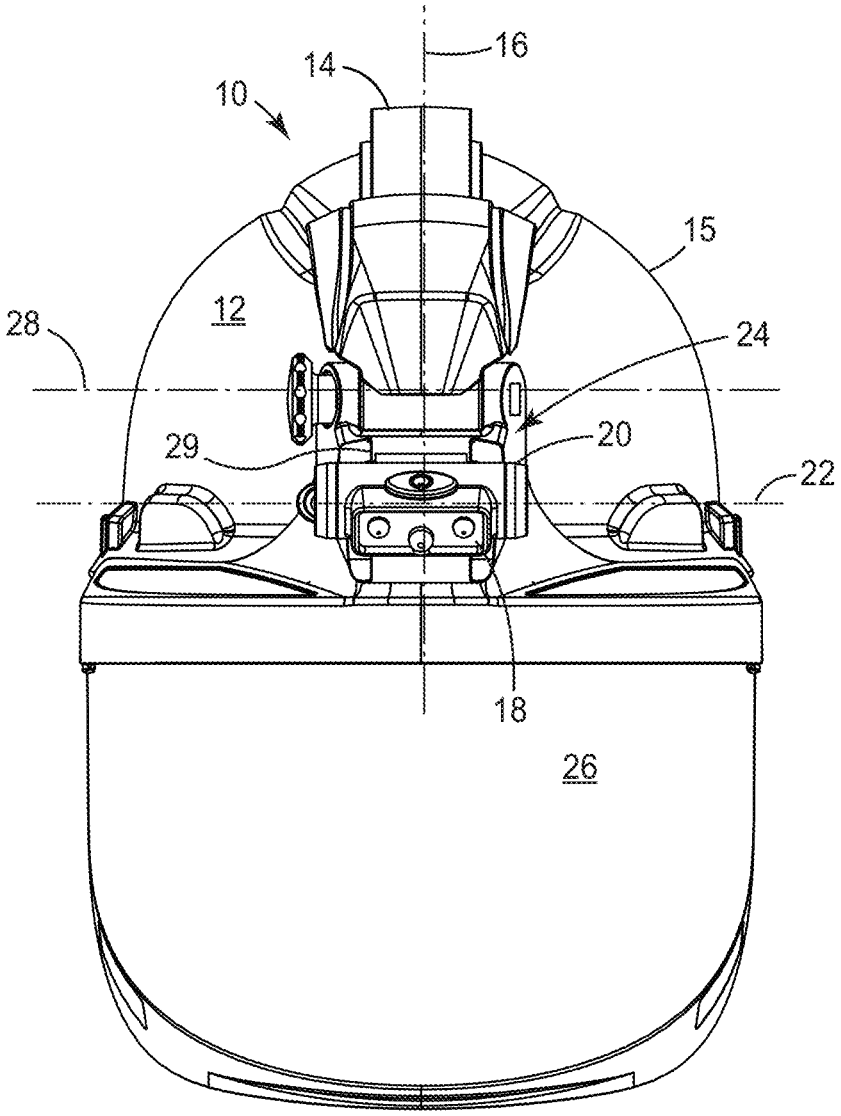
FIG. 1 is a front view of an appliance mounting device 10, in accordance with the present invention, attached to a hard hat 12.

FIG. 1 shows an example of an appliance mounting device 10 of the present invention attached to a hard hat 12. The appliance mounting device 10 includes an elongated guide 14 that is adapted for removable securement to the hard hat 12. The hard hat 12 typically comprises a hard or rigid outer shell 15 and an inner harness. The rigid outer shell 15 protects the wearer's head from impact from objects in the surrounding environment. The inner harness enables the hard hat 12 to be supported comfortably on the wearer's head. The elongated guide 14 may be supplied together or separate from the hard hat 12 to which it is attached. The elongated guide 14 has a lengthwise dimension that is at least generally coincident with a sagittal plane 16 of the hard hat 12. The elongated guide 14 is configured so that when it is attached to head gear, the lengthwise dimension of the elongated guide 14 is at least generally coincident with the sagittal plane 16. By "at least generally coincident" is meant that the lengthwise dimension of the elongated guide is oriented at an angle of within plus or minus about 25 degrees of the sagittal plane. In some embodiments the lengthwise dimension of the elongated guide may be oriented within plus or minus about 10 degrees of the sagittal plane, and in further embodiments, it may be oriented with plus or minus about 2 degrees of the sagittal plane 16. By at least generally coincident is also meant that the lengthwise dimension of the elongated guide is located at distance of no greater than about 4 cm to either lateral side of the sagittal plane of the hard hat, at all points along the elongated length of the guide. In further embodiments, the lengthwise dimension of the elongated guide may be located at a distance of no greater than about 3 cm, or 2 cm, to either lateral side of the sagittal plane of the head gear. In particular embodiments, the lengthwise dimension of the elongated guide is aligned with (e.g., overlaps) the sagittal plane of the head gear.

As further shown in FIG. 1, an appliance 18 is supported by an appliance holder 20. The appliance holder 20 can be integral to the appliance 18, or it may be a separate part as described below. The appliance holder 20 may be secured to the elongated guide 14 to allow for adjustment of the position of the appliance 18 along the lengthwise dimension of the elongated guide 14. The appliance holder 20 may be slidably moved forward and backward along the lengthwise dimension of the elongated guide 14. The position adjustments also can be fashioned to allow for incremental adjustment of the appliance holder 20 position. The appliance 18 also may be rotated about one or more axes. For example, the appliance 18 may be rotated about an axis 22 that runs normal to the lengthwise dimension of the elongated guide 14. When the appliance is a powered flashlight, the direction of the light beam emanating from the appliance can be varied by moving the appliance lengthwise along the elongated guide or by rotating the appliance 18 around axis 22. The appliance holder 20 can be removably attached to the elongated guide 14 to enable the appliance to be removed from the guide 14 and placed at another location, for example, at another location on the hard hat 12 or on the bracket 24 for the face shield 26. The face shield 26 also can be removably attached to the elongated guide 14. The face shield position too can be altered along the lengthwise dimension of the elongated guide 14. The face shield 26 can be secured to the elongated guide 14 using a removable face shield bracket 24. To lift the face shield 26 upwardly away from the user's face, the face shield bracket 24 may be hinged and rotatable about an axis 28. The face shield bracket 24 also can be provided with an elongated guide 29 to which the appliance holder 20 can be secured. The appliance holder 20 can be moved from a first position to a second position to allow for adjustment of the appliance position along the lengthwise dimension of this second elongated guide 29. In addition to the appliance 18 and the face shield 26, other items or appliances may be attached to the elongated guide(s) 14 and 29. A description of a face shield that is removably attached to an elongated guide can be found in co-pending U.S. patent application Ser. No. 13/627,571 to Daniels et al. entitled Elongated Guide, and Visor Removably Mounted Thereto.

Figure 2:
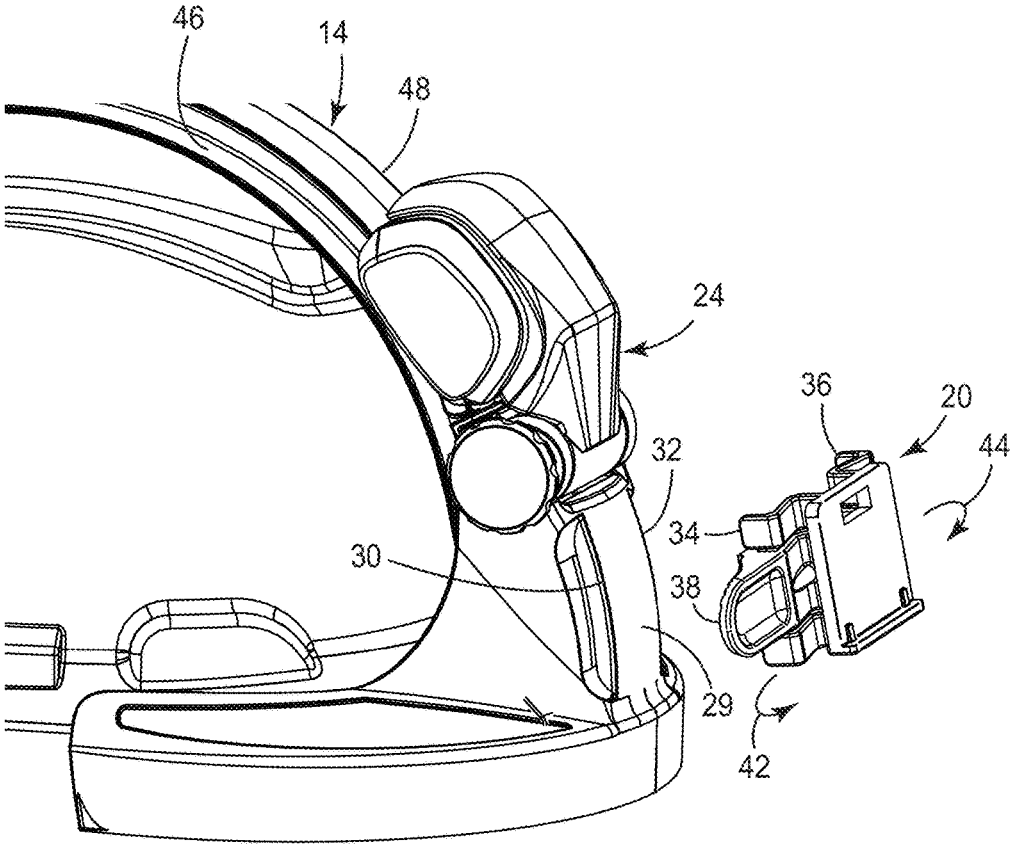
FIG. 2 is a perspective view of an appliance mounting device 10 having the appliance holder 20 removed from the elongated guide 14.

FIG. 2 shows how the appliance holder 20 can be removably secured to the elongated guide 29 on the face shield bracket 24. The face shield bracket 24 has first and second rails 30 and 32, which can be placed within first and second grooves 34 and 36 of the appliance holder 20. To secure the appliance holder 20 to the face shield bracket 24, a first tab 38 can be pressed away from the guide 29 to cause the grooves 34 and 36 to move apart or away from each other, allowing the rails 30 and 32 to be inserted therein. When the tab 38 is so pressed, the grooves 34, 36 each rotate, respectively, about an axis in the direction of arrows 42, 44. An appliance may be secured to the appliance holder 20 before or after securement of the holder 20 onto the face shield bracket 24. The face shield bracket 24 in turn is secured to the elongated guide 14, which also has first and second rails 46 and 48. Rails 46 and 48 may be sized and spaced similar to rails 30 and 32 so that appliances secured to rails 30 and 32 can also be secured to rails 46 and 48 or vice versa. The face shield bracket 24 may be moved along the lengthwise dimension of the elongated guide 14. When a wearer desires to move the face shield 26 away from their face, the face shield bracket 24 can be moved rearwardly along the rail system of the elongated guide 14. The elongated guide 14 is configured so that face shield 26 is removably mountable thereto, and is further configured so that when the face shield 26 is removably mounted thereto, the elongated guide 14 slidably supports face shield bracket 24 so that face shield 26 can be moved generally along the lengthwise dimension of elongated guide 14 at least between the first and second (shielding and retracted) positions.

Figure 3:
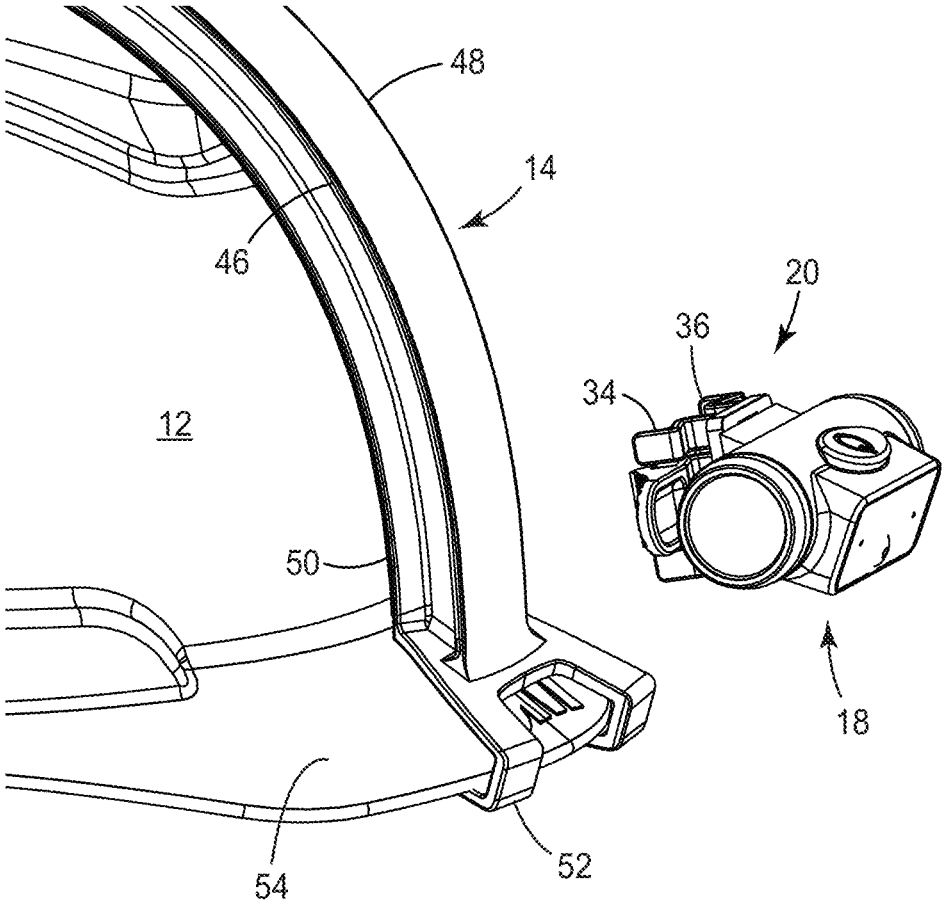
FIG. 3 is a perspective view of an elongated guide 14 where the appliance holder 20 is separated from the guide 14.

FIG. 3 shows how an appliance holder 20 can be secured to the first elongated guide 14. The tab 38 can be pressed away from the rails 46, 48 to cause the grooves 34 and 36 to move apart, allowing the rails 46 and 48 to be inserted therein. The appliance 18 may be secured to the appliance holder 20 before or after securement of the holder 20 to the rail system of the elongated guide 14. Alternatively, the appliance 18 and holder 20 can be formed as a single integral part by, for example, injection molding the appliance 18 and holder 20 at the same time. The appliance holder 20 may be moved along the lengthwise dimension of the elongated guide 14. When a wearer desires to move the appliance 18 to a higher elevation, the appliance holder 20 can be moved rearwardly along the rail system of the elongated guide 14. As mentioned above, the elongated guide 14 is removably attachable to head gear. It can be supplied already attached to a head gear, or it can be supplied separately and then attached to the head gear by the user. The elongated guide may comprise an elongated main body made of any suitable material such as metal, thermoplastic molding material, etc., as well as any number of ancillary components such as straps, clips, latches, etc. which may be needed for various purposes. The elongated guide may often be at least generally linear when viewed from a perspective aligned with the sagittal plane (e.g., when a head gear and the attached elongated guide are viewed from directly vertically above). The elongated guide often may be generally arcuate when viewed from a perspective generally normal to the sagittal plane as seen in FIG. 1. An arcuate design of the elongated guide conveniently may allow the elongated guide to follow, at least generally, the curvature of an item of head gear to which the elongated guide is attached. The elongated guide lengthwise dimension often may be arcuate when viewed normal to the lengthwise dimension. The elongated guide curvature can be adapted, as desired, to accommodate the item of head gear. The guide does not have to be provided strictly as an arc of a circle; nor does it have to exactly match the curvature of a head gear to which it is attached. For example, the elongated guide may comprise a rear portion that diverges from the radially-outward surface of the head gear rather than strictly following the curvature of it. Thus in general, the curvature of the elongated guide is not required to remain constant along the elongated length of the guide. The elongated guide may be removably attached to the head gear in essentially any suitable manner. The elongated guide may be conveniently attached to the head gear using a front attachment mechanism, for example, by way of front attachment bracket 52, which bracket 52 may be fitted onto a front brim 54 (e.g., bill or eyeshade) of a hard hat 12. A similar rear attachment mechanism also can be provided to secure the second end of the elongated guide 14 to the to the hard hat 12. The rear attachment mechanism may be an adjustable mechanism, by which is meant that the mechanism can be adjusted so that the guide can be attached to head gears of different sizes, shapes, and configurations. In some embodiments, the front and rear attachment mechanisms may be the only mechanisms used to attach the elongated guide to the head gear. In other embodiments, other attachment mechanisms might be used at some other location in conjunction with or lieu of the mechanisms described above. A crown portion, for example, of the elongated guide may be attached to a crown portion of the head gear. Further, any portion of the crown portion of the elongated guide may comprise an adjustment mechanism that enables the guide length to be adjusted so that the guide can be tightly attached to any particular head gear.

Figure 4:
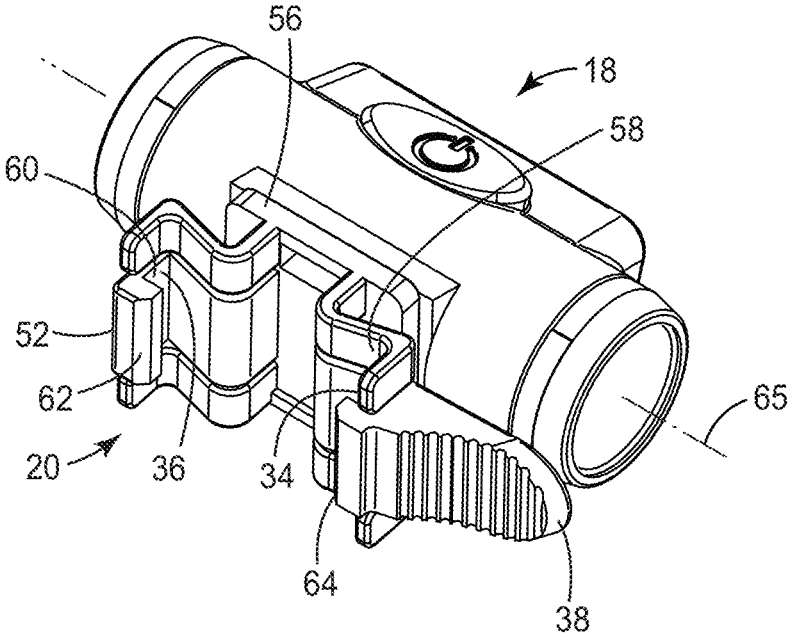
FIG. 4 is a rear perspective view of the appliance holder 20.

FIG. 4 shows the appliance holder 20 having an appliance 18 secured thereto. The appliance 18 is mounted to a central platform 56 on the holder 20. Each groove 34 and 36 are defined by first and second walls 58 and 60 and first and second ridges 62 and 64. The ridges 62, 64 can be beveled to allow for easy securement of the holder 20 to a rail system. The holder 20 can be placed on the first and second rails of the rail system to which the holder 20 is desired to be joined. By further pressing the holder 20 towards the rail system, the beveled ridges 62, 64 on the walls 58, 60 cause the grooves 34, 36 to move normal to the direction of the applied force, that is, the grooves move apart from each other, allowing the first and second rails to be inserted into the first and second grooves 34 and 36. As indicated above, the pressing of tabs 38 and 40 towards each other also causes the grooves 34, 36 to move apart to enable securement of the holder 20 to the rail system. In a further embodiment only one tab may be employed on one of the groove members 34 or 36 to cause the grooves to separate to accommodate the rail system. The appliance holder 20 can be fashioned to allow the appliance 18 to be rotated about one or more axes 65. This rotational movement enables the appliance 18 to be precisely positioned for use. Such positioning can be particularly beneficial when the appliance is a flashlight.

Figure 5:
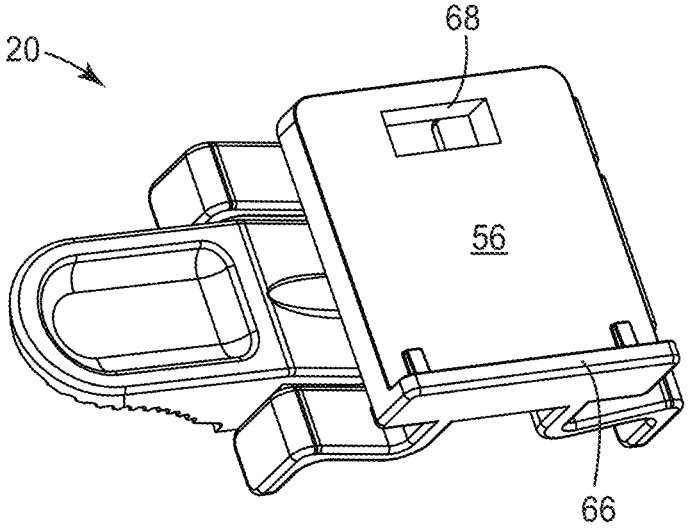
FIG. 5 is a front perspective view of the appliance holder 20.
Figure 6:
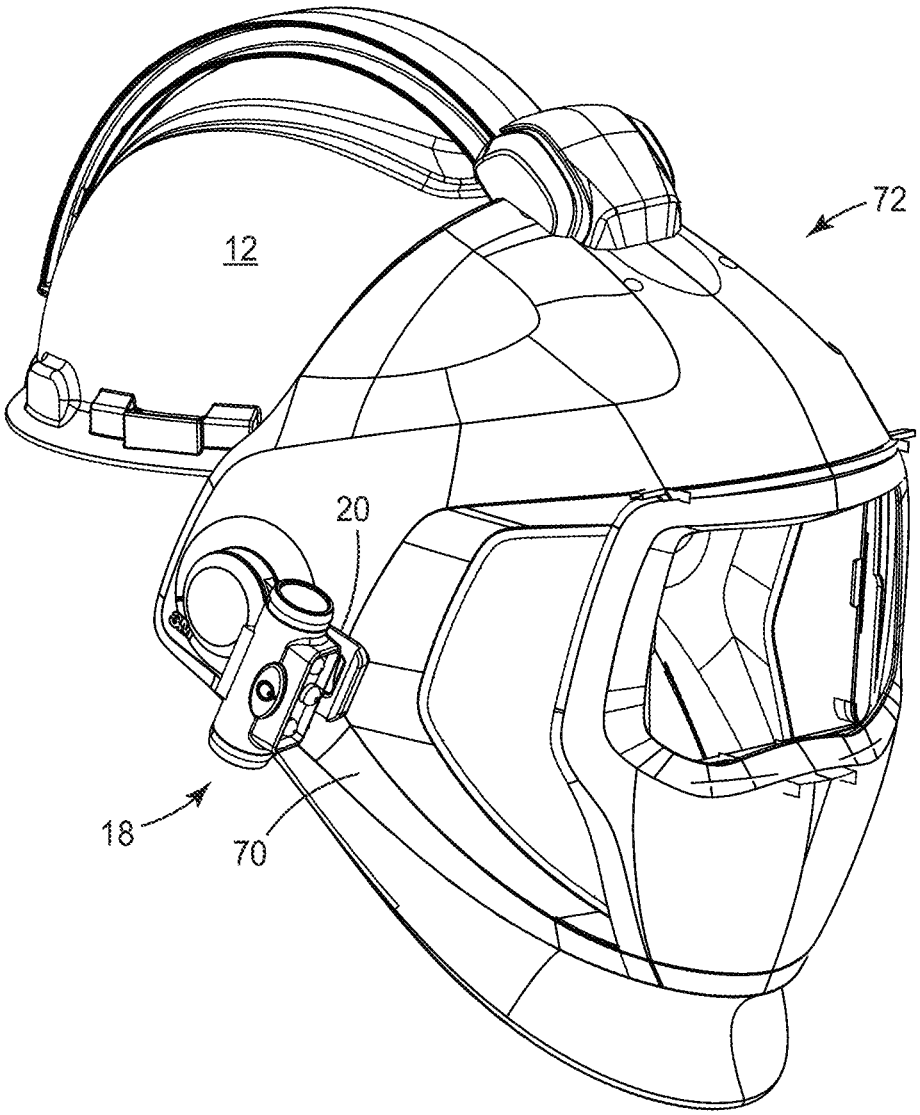
FIG. 6 is a front perspective view of a welding shield 72 having an appliance 18 mounted to the welding shield side 70.

FIG. 5 shows the reverse side of the appliance holder 20 without an appliance being secured thereto. The central platform 56 has a short wall 66 disposed along one edge of the platform 56 and has a rectangular opening 68 located within the platform 56. The appliance 18 is mounted to the platform 56 by sliding the platform 56 into slots on the appliance until it stops at the wall 66. A snap or hook on the appliance 18 enters into the opening 68 and prevents it from sliding out again. The appliance 18 can be removed by pressing the snap/hook and then sliding the platform 56 back out again FIG. 6 shows how the appliance 18 can be secured to head gear at still further locations. The appliance 18 may be mounted to the side 70 of a welding shield 72. The welding shield 72 can engages a hard hat 12. The appliance 18 may be mounted in an appliance holder 20 similar to the appliance holder 20 described above. The invention therefore may allow multiple appliances to be secured to head gear or to parts that engage head gear. The appliances may be secured to the elongated guide 14 or to parts that are secured to the guide 14 as described above and they may be attached to one or more of the sides of the head gear. A wearer therefore could have, for example, one or more flashlights pointing at the same object during use or may have one flashlight pointed at a first object and another pointing at another.

Figure 7:
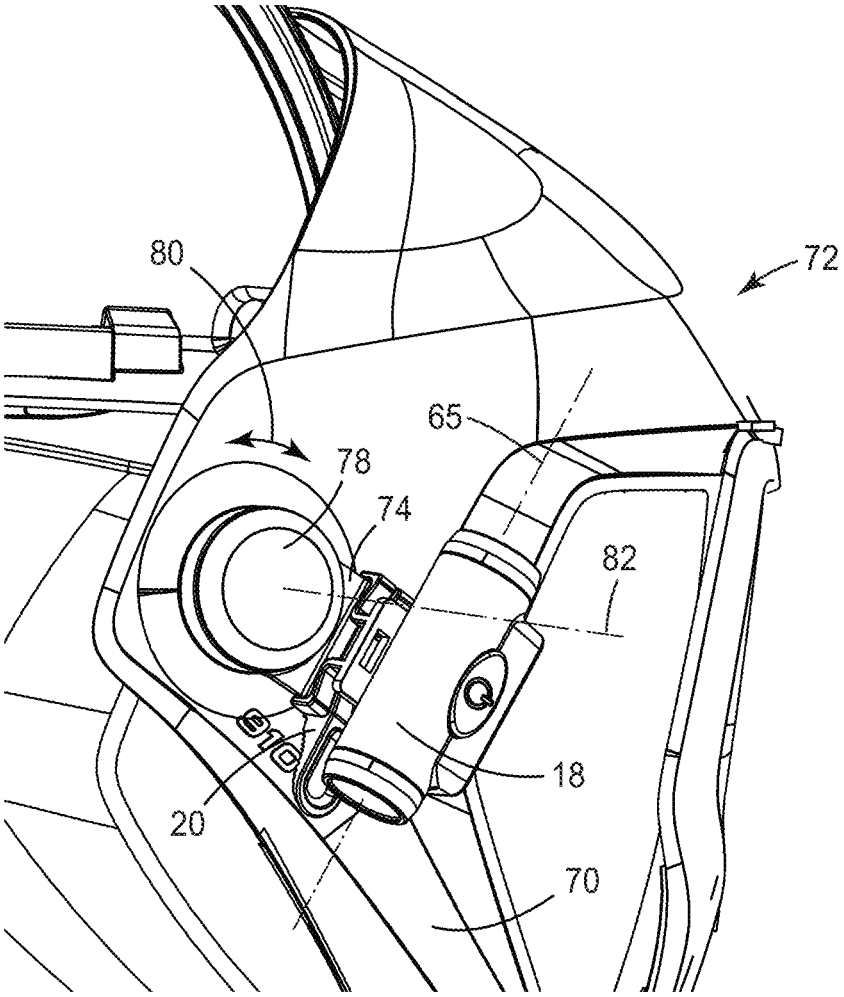
FIG. 7 is a rear perspective view of a welding shield 72, showing the appliance holder 20 attached to the elongated guide 74.

FIG. 7 shows how the appliance 18 can be secured to an appliance holder 20 that is securable to a smaller rail system or guide 74 located on the side 70 of the face shield 72. The rail system 74 may be secured to the face shield at a pivotable location 78, thereby allowing the appliance holder 20 and the appliance 18 to be rotationally positioned on the side of the head gear in the direction of arrow 80. An appliance so attached to the side of the head gear can be rotated about the axis 82 in the up and down direction or about the axis 65 (FIG. 4) in the side-to-side direction or in the front to back direction along the guide 74. The head gear that is used in the present invention may not only include the hard hat and welding helmets described above but may also include bump caps, sports or athletic helmets, military helmets, construction helmets, fireman's helmets, etc.

What is claimed is:

1. An appliance system suitable for use with head gear, the appliance system comprising:

a first elongated guide that is arcuate and attachable to head gear at a first location, wherein the first elongated guide comprises first and second rails;

a first appliance;

a first appliance holder that supports the first appliance and that can engage the first elongated guide to allow for adjustment of the position of the first appliance along the lengthwise dimension of the first elongated guide, wherein the first appliance holder comprises first and second grooves and a tab connected to the first groove, wherein the first and second rails of the first elongated guide are disposed within the first and second grooves of the first appliance holder respectively when the first appliance holder is engaged with the first elongated guide, and further wherein the first appliance holder can be disengaged from the first elongated guide by pressing the tab away from the first and second rails of the first elongated guide such that the first and second grooves of the first appliance holder move apart from each other;

a second elongated guide secured to the first appliance;

a second appliance; and a second appliance holder that supports the second appliance and that can engage the second elongated guide to allow for adjustment of the position of the second appliance along the lengthwise dimension of the second elongated guide.

2. The appliance system of claim 1, wherein the first appliance comprises a face shield, wherein the second elongated guide is secured to a side of the face shield.

3. The appliance system of claim 2, wherein the second elongated guide is secured to the side of the face shield at a pivotable location such that the second appliance holder and the second appliance are rotationally positioned on the side of the face shield.

4. The appliance system of claim 1, wherein the first and second appliance holders allow for incremental adjustment of the position of the first and second appliances along the first and second elongated guides respectively.

5. The appliance system of claim 1, wherein the first elongated guide is flexible to allow it to be adapted to the shape of the head gear.

6. The appliance system of claim 1, wherein the first appliance is a light, a camera, a sensor, a communication device, or a gps device.

7. The appliance system of claim 6, wherein the second appliance is a light, a camera, a sensor, a communication device, or a gps device.

8. The appliance system of claim 7, wherein both the first appliance and the second appliance are flashlights.

9. The appliance system of claim 1, wherein the first appliance is integrally attached to the first appliance holder.

10. The appliance system of claim 1, wherein the second appliance is integrally attached to the second appliance holder.

11. The appliance system of claim 1, wherein the first elongated guide is removably attachable to a hardhat such that a lengthwise dimension of the first elongated guide is at least generally coincident with a sagittal plane of the hardhat.

12. The appliance system of claim 1, wherein the second elongated guide comprises first and second rails, wherein the second appliance holder comprises first and second grooves and a tab connected to the first groove, wherein the first and second rails of the second elongated guide are disposed within the first and second grooves of the second appliance holder respectively when the second appliance holder is engaged with the second elongated guide, and further wherein the second appliance holder can be disengaged from the second elongated guide by pressing the tab away from the first and second rails of the second elongated guide such that the first and second grooves of the second appliance holder move apart from each other.

13. An article of head gear, which article comprises a helmet and the appliance system of claim 1.

* * * * *